US007163141B1

(12) United States Patent
Parker

(10) Patent No.: US 7,163,141 B1
(45) Date of Patent: Jan. 16, 2007

(54) DETACHABLE BOX AND ASSEMBLY

(76) Inventor: Kenneth A. Parker, 8710 Foley Rd., Racine, WI (US) 53402

( * ) Notice: Subject to any disclaimer, the term of this patent is extended or adjusted under 35 U.S.C. 154(b) by 160 days.

(21) Appl. No.: 10/826,856

(22) Filed: Apr. 16, 2004

(51) Int. Cl.
*A47G 29/12* (2006.01)

(52) U.S. Cl. ..... 232/39; 248/146; 248/219.2

(58) Field of Classification Search ..... 232/39, 232/38, 17; 248/219.2, 128, 146, 154, 424, 248/429
See application file for complete search history.

(56) References Cited

U.S. PATENT DOCUMENTS

| | | | | | |
|---|---|---|---|---|---|
| 2,552,915 | A * | 5/1951 | Zachrich | 248/154 |
| 4,813,595 | A | 3/1989 | Johns, Jr. et al. | |
| 4,821,952 | A | 4/1989 | Deciutiis | |
| 4,872,610 | A * | 10/1989 | Grabowiecki | 232/17 |
| 4,893,747 | A * | 1/1990 | Roth | 232/39 |
| 4,955,534 | A * | 9/1990 | Raible | 232/39 |
| 5,323,959 | A | 6/1994 | Draper | |
| 5,346,125 | A | 9/1994 | Critzer, Sr. | |
| 5,400,958 | A * | 3/1995 | Walker | 232/39 |
| 5,622,343 | A * | 4/1997 | Morton | 248/131 |
| 5,699,989 | A * | 12/1997 | Guthrie | 248/219.2 |
| 6,161,756 | A * | 12/2000 | Upton | 232/39 |
| 6,378,768 | B1 | 4/2002 | Belloise | |
| 6,474,543 | B1 * | 11/2002 | Grell | 232/38 |
| 6,543,680 | B1 * | 4/2003 | McCormack | 232/39 |
| 6,662,997 | B1 * | 12/2003 | Smith et al. | 232/39 |
| 6,955,291 | B1 * | 10/2005 | Knight | 232/39 |

* cited by examiner

*Primary Examiner*—William L. Miller
(74) *Attorney, Agent, or Firm*—Boyle Fredrickson Newholm Stein & Gratz, S.C.

(57) ABSTRACT

A detachable box assembly designed to allow for the quick-release of a box from a box receiving surface. The assembly consists of two slidably secured attachment plates configured to be attached to the base of a box and the support of the receiving surface post. The plates are configured for attaching the box to the box receiving surface. The assembly further comprises a locking mechanism configured to prevent the removal of the attachment plates and thereby secure the box to the box receiving surface.

20 Claims, 8 Drawing Sheets

DETACHABLE BOX AND ASSEMBLY

BACKGROUND OF THE INVENTION

1. Field of the Invention

The present invention relates in general to the field of mailboxes and newspaper boxes and attachment assemblies for the same. More particularly, the present invention relates to a delivery-receiving box having a quick-release attachment. Specifically, a preferred embodiment of the present invention relates to a dual plate system for attachment to a box and a box post to make the box removable from the post, without the use of tools.

2. Discussion of the Related Art

In the past several years, decorative mailboxes and delivery receiving boxes have become increasingly popular. Numerous different themes have been applied to boxes. For example, these boxes have been designed to reflect an individual's special interests, such as farming, pets, sailing or lighthouses. Such boxes have also been designed to reflect an individual's support for their favorite sports teams or activities. Such boxes are also designed with seasonal or nature themes.

Typically, delivery-receiving box decorations are provided as decorative designs which are painted or stenciled on, or otherwise permanently applied to the box such as by permanently fastening an overlay to the box. An individual selects a box having the decorative design which suits his or her fancy. However, given the wide variety of decorative boxes available these days, an individual may find that a particular decorative design of a selected box may be out of style, or the purchaser may simply become tired of the same design. Alternatively, an individual may desire a variety of boxes to change according to their personal preference and the season or event. Heretofore, if an individual desired to change his box, the individual was required to perform a labor intensive process of removing screws and/or other fasteners to remove the box and replace it with a new box.

Unfortunately, there does not currently exist a good solution to the above-mentioned problem. If an individual wanted to take advantage of the wide variety of such boxes available to the public, he was required to attach and remove the box in the traditional means practiced in the art. This labor intensive process has led many to not fully enjoy the wide variety of boxes available. The below-referenced U.S. patents disclose embodiments that were at least in-part satisfactory for the purposes for which they were intended. The disclosures of all the below-referenced prior United States patents in their entireties are hereby expressly incorporated by referenced into the present application for purposes including, but not limited to, indicating the background of the present invention and illustrating the state of the art.

U.S. Pat. No. 4,813,595 to Johns, Jr. et. al. discloses a mailbox with flanges located on the bottom outside periphery of the mailbox. The flange defines a groove to support decorative mailbox overlays which are then secured by rivets. The '596 patent, however, is unsatisfactory because there has not been widespread manufacture of the decorative overlays, the attachment of the overlays is complex, and there is no antitheft mechanism to protect the overlays. Furthermore, many of the decorative mailboxes incorporate non traditional housing shapes, such as a mailbox shaped as a lighthouse or football helmet, that do not fit within the overlay design.

Likewise, U.S. Pat. No. 4,872,610 to Grabowiecki discloses a display mailbox having an enclosure and an exterior surface having a recess for displaying an insert for a decorative piece of sheet material. U.S. Pat. No. 5,346,123 to Critzer, Sr. discloses a similar designer mailbox with decorative side panels. Again, these designs are limited in their capacity to display only different design sheets. Alternative mailboxes cannot be utilized.

SUMMARY AND OBJECTS OF THE INVENTION

In view of the foregoing, it is a primary object of the present invention to provide a delivery-receiving box assembly that can be attached to existing boxes and enable the mailboxes to be easily removed and secured to a box post. It is another object of the invention to provide a box that can be easily removed and secured to a box post. Moreover, the inventive box and box assembly should have a security feature to prevent removal or theft of the box. Yet another object of the invention is to provide a method that can be used to relatively inexpensively and conveniently transform a box into a quick release box assembly. A final object of the invention is to provide a quick release box assembly which is economical to manufacture and easy to install.

Consistent with the foregoing objects, and in accordance with the invention as embodied and broadly described herein, an apparatus is disclosed, in suitable detail to enable one of ordinary skill in the art to make and use the invention. A detachable box assembly designed to attach to boxes and box posts to enable a box to be easily removed form the post is described. The assembly consists of a first attachment plate configured to be attached to the bottom of a box and a second attachment plate configured to be attached to a box post. The attachment plates are designed to be releasably engageable with one another such that the plates can easily be slidably attached. The plates allow for the quick release of a box from a box post. The invention contemplates both a box and box post including the attachment plates and alternatively, the plates as an attachment assembly to be added to existing assemblies. Various locking features are also described as part of the attachment plates to prevent removal of the attachment plates.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DETAILED DESCRIPTION OF THE INVENTION

Figure 1:
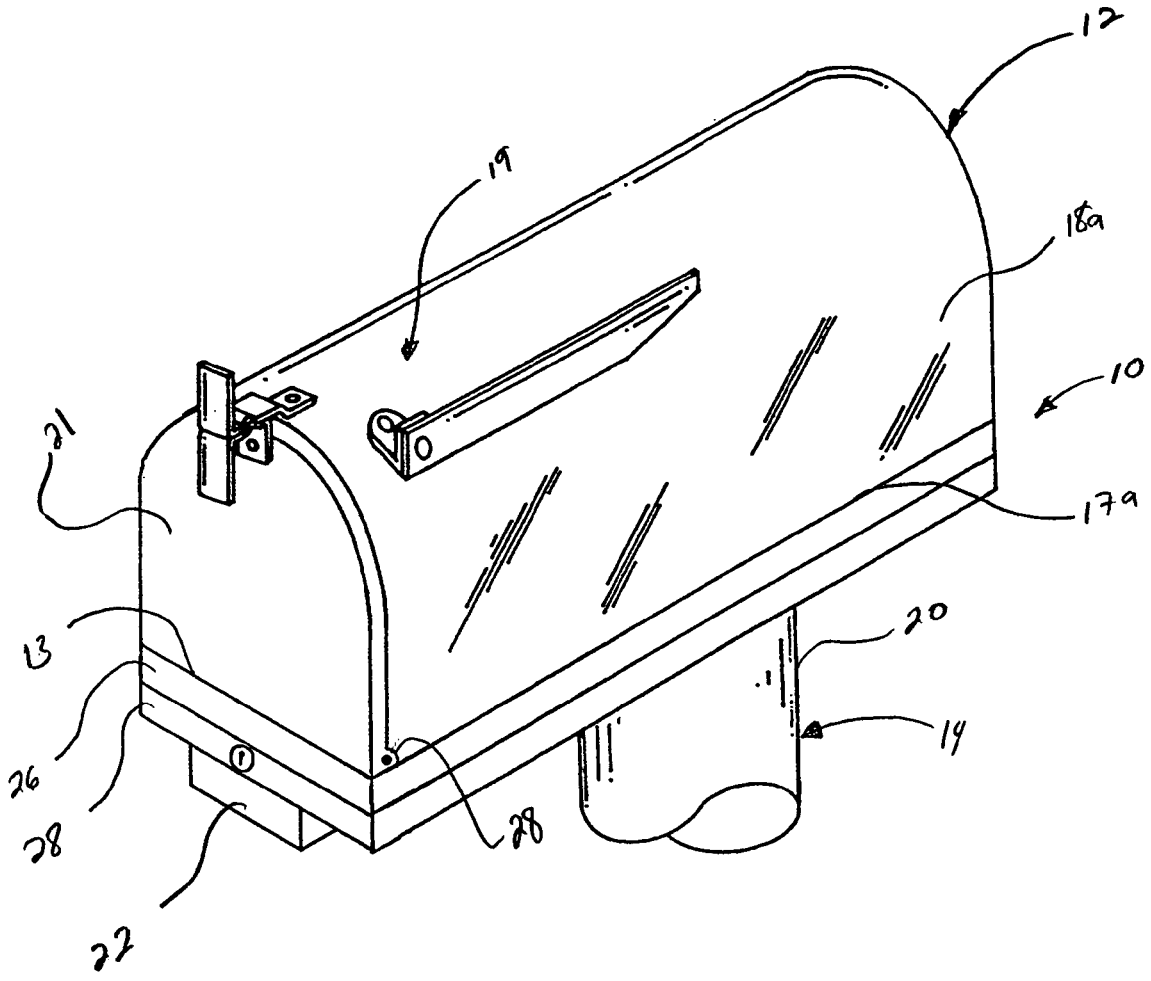
FIG. 1 is a perspective illustration of the preferred embodiment of a delivery receiving box having the inventive attachment plates in accordance with the principles of the present invention.
Figure 2:
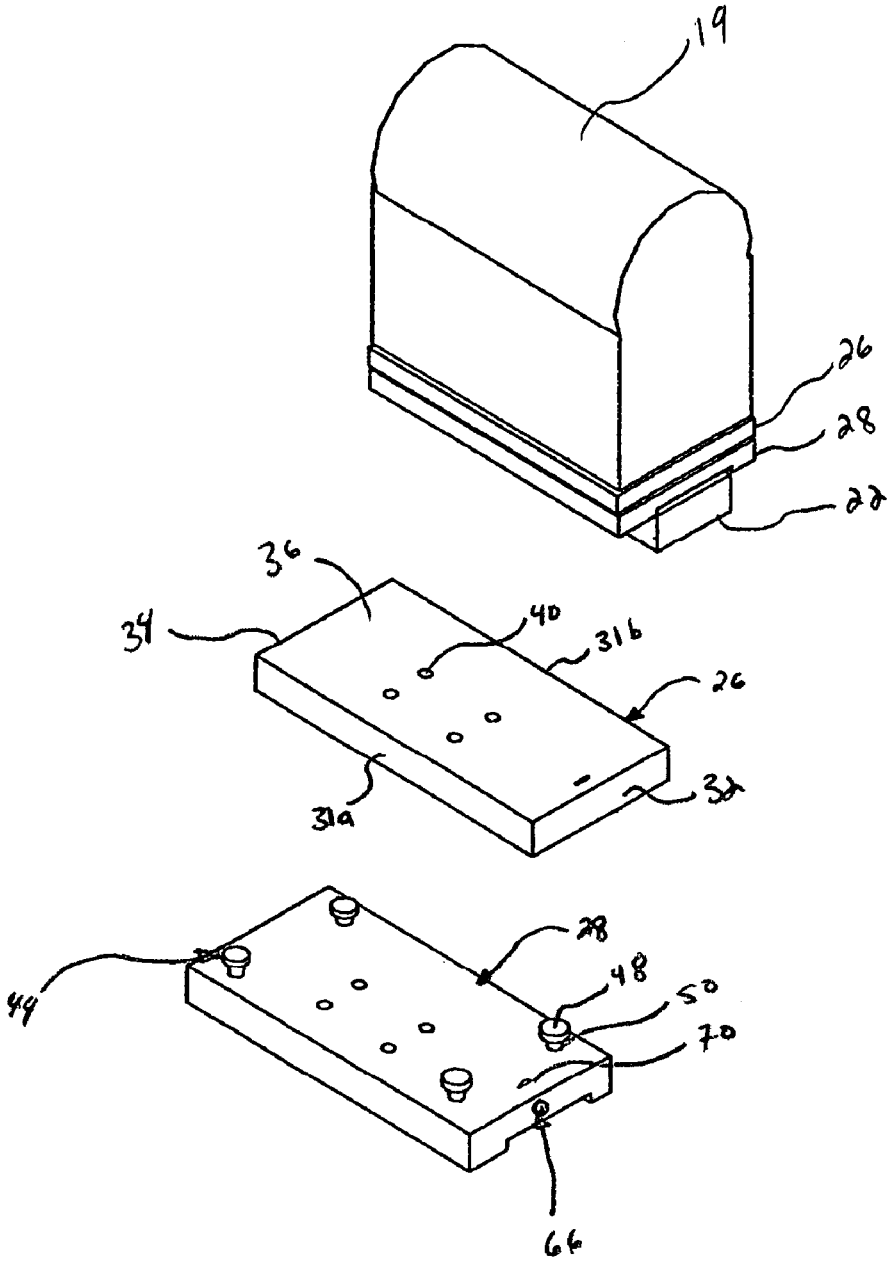
FIG. 2 is a schematic partially exploded view of the box assembly shown in FIG. 1.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected" or terms similar thereto are often used. Such terms are not limited to direct connection but include connection through other elements where such connection is recognized as being equivalent by those skilled in the art.

1. System Overview

In its most basic form, the invention is an attachment to a delivery receiving box that enables the box to be quickly and easily removed from a box post without the use of tools. The attachment includes a pair of box attachment plates. One attachment plate is configured to be attached to a box post and the other is configured to be attached to the bottom of a box. The two attachment plates are configured to engage one another and preferably lock together thereby securing the box to the box post. Preferably, a locking mechanism secures the plates to ones another and prevents theft of the box.

2. Detailed Description of Preferred Embodiments

FIG. 1 illustrates one preferred box assembly 10 of the present invention. In this embodiment, a delivery receiving box, for example, a conventional mailbox 12, is secured to a conventional receiving surface e.g., box post 14. The mailbox 12 includes a generally rectangular base plate 16, the base plate 16 having generally parallel side edges 17*a*, 17*b* extending longitudinally therealong with parallel front 13 and rear 15 edges extending therebetween. The mailbox 12 further comprises a pair of integral planar exterior sidewalls 18*a*, 18*b* extending upwardly from the side edges of the base plate to form an arcuate exterior roof 19 integrally connected to the upper end of respective exterior side walls 18*a*, 18*b*. A U-shaped rear wall 24 connects the side walls 18*a*, 18*b* and base plate 16 at the distal end of the mailbox 12. The base plate 16, sidewalls 18*a*, 18*b*, and rear wall 24 define an enclosure for receiving mail through the proximal end of the mail box 12. A mailbox door 21 is pivotally connected to the sidewalls 18*a*, 18*b* with a hinge 28 for selectively covering the opening of the enclosure defined by the mailbox 12.

Figure 4:
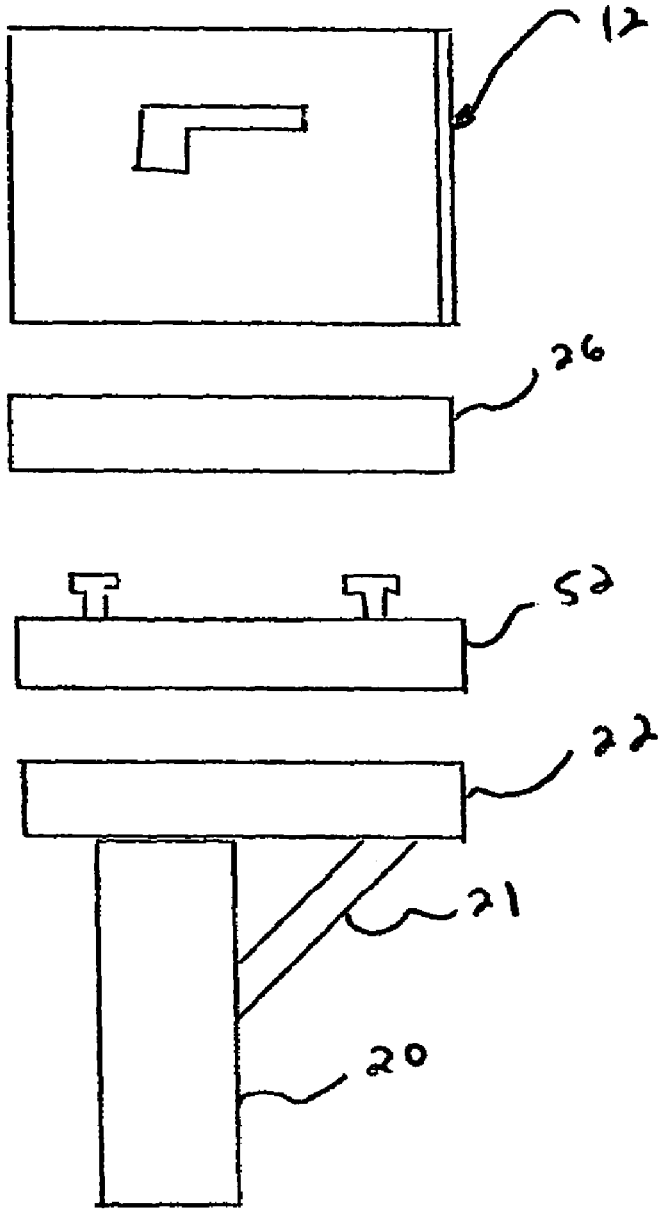
FIG. 4 is a schematic partially exploded view of the box assembly shown in FIG. 1.

The mailbox 12 is supported by a mailbox post 14. The mailbox post 14 is comprised of a vertical post 20 and a horizontal mounting post 22. As illustrated in FIG. 4, the post 14 may also include a diagonal support post extending between the vertical post 20 and horizontal post 22 for added support. Although a specific mailbox 12 and mailbox post 14 have been described, it should be understood that the inventive concept is in no way limited by these configurations. These configurations are for illustrative purposes only, and the inventive concept covers numerous variations in delivery receiving boxes, e.g., mailboxes, newspaper boxes and their various receiving surfaces, e.g., the conventional posts. It will become evident, that the specific configuration of the mailbox 12 and mailbox post 14 are not critical for the present invention.

Attached to the base plate 16 of the mailbox 12 is a preferably rectangular first attachment plate or mailbox attachment plate 26. Attached to the horizontal mounting post 22 of the mailbox post 14 is a preferably rectangular second attachment plate or post attachment plate 28. As illustrated in embodiment shown in FIG. 1, the first attachment plate 26 is configured to mate with the second attachment plate 28 and allow for slidable attachment. The attachment plates 26, 28 can be created from metal, plastic, wood or any other sufficiently durable and weather-resistant material known and used in the art.

FIGS. 2–5 better illustrate the details of the first 26 and second 28 attachment plates. The first attachment plate 26 is a generally rectangular plate having generally parallel sides 31*a*, 31*b* extending longitudinally therealong with parallel front 32 and rear 34 sides extending therebetween. The first attachment plate 26 further includes a top mailbox engaging surface 36 and a bottom plate engaging surface 38. The distance between the sides 31*a* and 31*b* define the width of the engagement plate 26. The distance between the top surface 36 and the bottom surface 38 define the depth of the plate 26. In the preferred embodiment illustrated in FIGS. 1–5, the top surface 36 includes a plurality of spaced apertures 40 configure to receive a nut and bolt, rivet, screw or other attachment means. The attachment means (not shown) is inserted through the apertures 40 in order to secure the first attachment plate 26 to the underside of the mailbox base plate 26.

Figure 3:
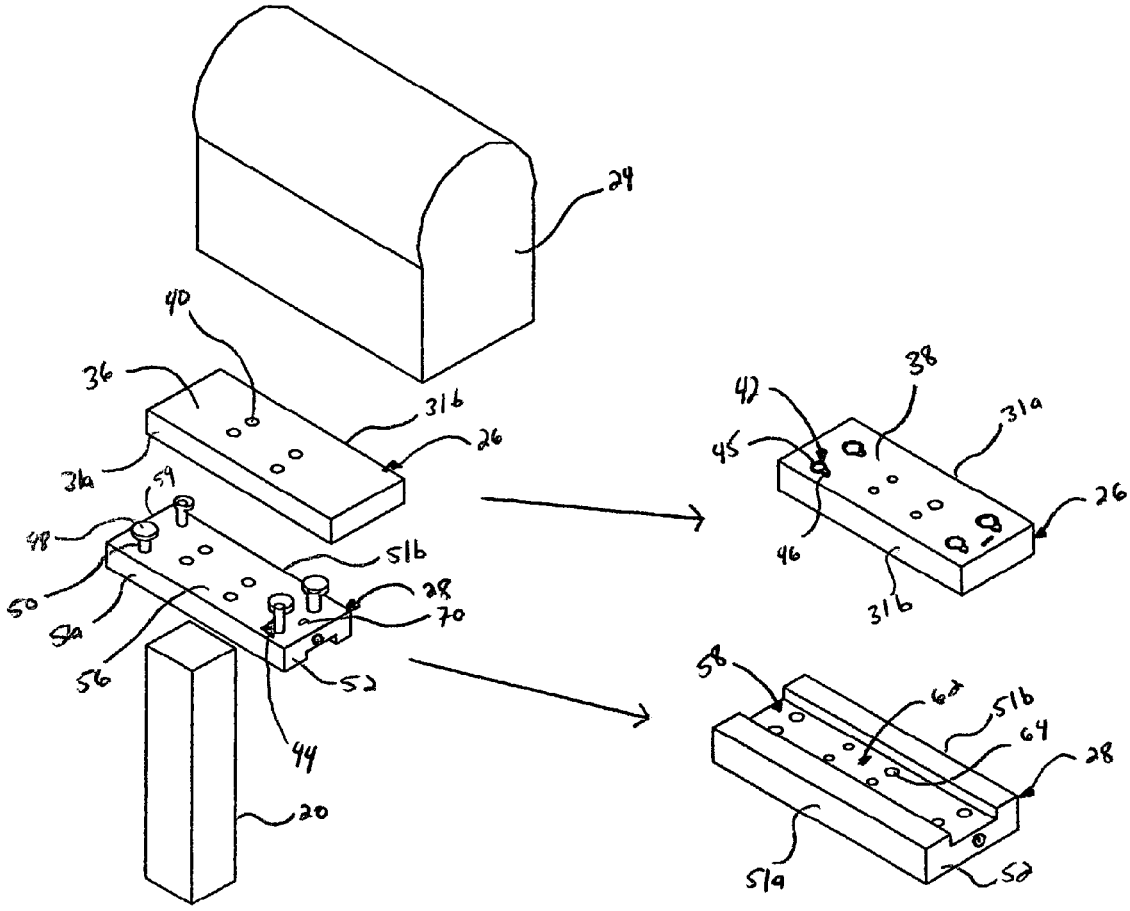
FIG. 3 is a schematic partially exploded view of the box assembly shown in FIG. 1.
Figure 5:
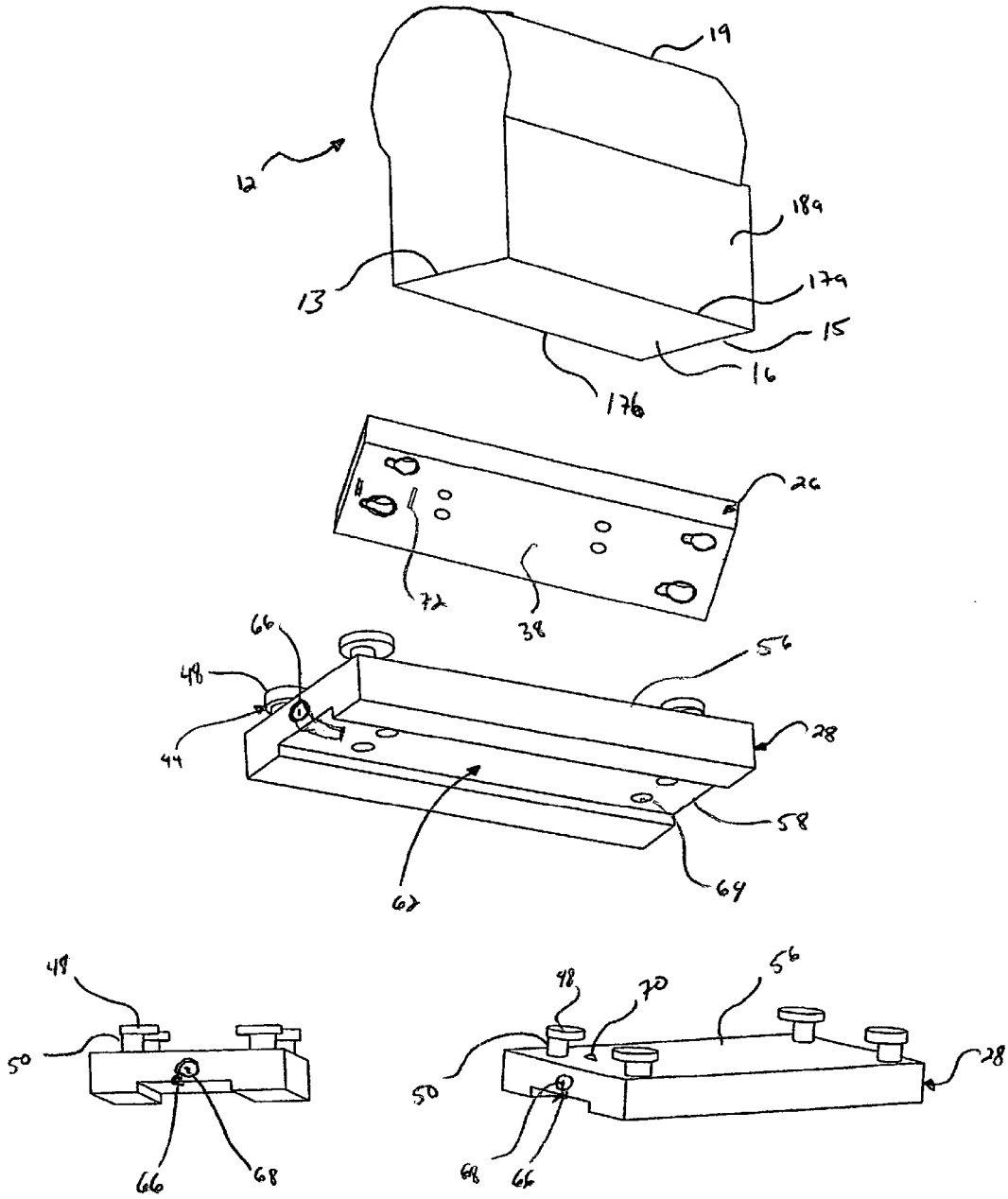
FIG. 5 is a perspective illustration of the attachment plates shown in FIG. 1.

As best illustrated in FIGS. 3 and 5, the plate engaging surface 38 may be configured to be releasably engageable with the top surface 56 of the second attachment plate 28. This may also be accomplished by the use of a device for releasably securing the plate engaging surface 38 to the top surface 56. The device includes four tab receiving holes 42 configured to receive engagement tabs 44 of the second attachment plate 28. The tab receiving holes 42 include a preferably circular portion 45 and a narrower slot region 46 extending therefrom. As will be explained further below, the circular portion 45 is configured to receive the preferably oval or circular tab 48 of the engagement tab 44 and the slot 46 is configured to restrict the circular tab 48 while allowing free movement of the stem 50 of the engagement tab 44. The slot 46 is shaped like a traditional skeleton key hole. The circular tab 48 can be either centered on the stem 50 of the engagement tab 44 (FIG. 2) or alternatively, slightly offset as illustrated in FIGS. 3 and 5).

The second attachment plate 28 is configured to align with the first attachment plate 26 to secure the mailbox 12 to the mailbox post 14. The second attachment plate 28 is also a generally rectangular plate having generally parallel sides 51*a*, 51*b* extending longitudinally therealong with parallel front 52 and rear 54 sides extending therebetween. The second attachment plate 28 further includes a top plate engaging surface 56 and a bottom post engaging surface 58.

The distance between the sides 51*a* and 51*b* define the width of the attachment plate 28. The distance between the top surface 56 and bottom surface 58 define the depth of the plate 28.

In the preferred embodiment illustrated in FIGS. 1–5, the top surface 56 of the second attachment plate includes four engagement tabs 44 configured to fit within the tab receiving holes 42 of the first attachment plate 26. As described above, the tabs 44 are comprised of a stem 50 connected to the plate 26, and a circular tab 48 at the end of the stem 50 configured to fit within the hole portion 45 of the tab receiving holes 44 and secure the plates 26, 28 to ones another. On the bottom surface 58 of the second plate 28 is a groove 62 configured to fit around a standard horizontal post 22 of a mailbox support post 22. Within the groove 62, on the bottom surface 58 of the second plate 28 are a plurality of spaced apertures 64 configured to receive a nut and bolt, rivet, screw or other attachment means. The attachment means (not shown) can be inserted through the apertures 64 to secure the second attachment plate 28 to the horizontal post 22.

Figure 8:
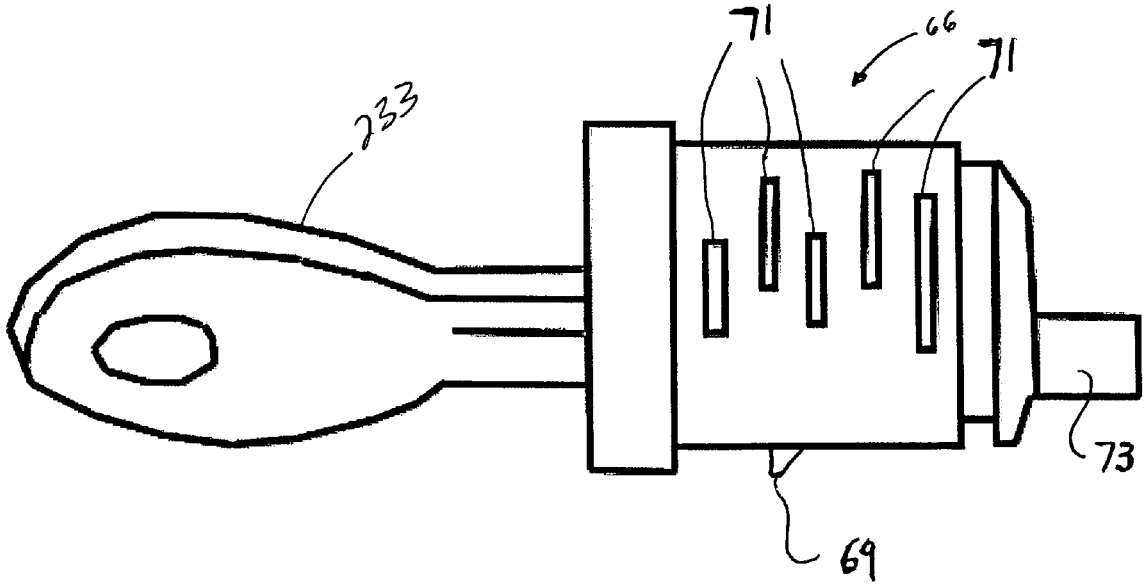
FIG. 8 is plan view of a locking assembly of the present invention.

The plates 26, 28 also include a locking mechanism 66 to prevent removal of the mailbox 12 when the plates have been secured together. As best shown in FIGS. 5 and 8, the second engagement plate 28, preferably includes a cam driven locking mechanism generally designated 66. Since, cam driven locks are well known in the art, the particulars of the locking mechanism need not be discussed in this application, but are incorporated by reference. The cam driven locking mechanism 66, is connected to and preferably made form plastic and molded within the second engagement plate, such that only the key hole 68 projects from the front side 52 of the engagement plate 28. Alternatively, as best shown in FIG. 8 the cylindrical locking mechanism 66 is placed into a cylindrically walled receiving cavity (not shown) in the plate and secured by a spring loaded protruding portion 69 that engages a hole in a sidewall of the cavity (not shown). Upon actuation of the locking mechanism 66 by a key 233, tumblers 71 moove a cam shaft 73 and the cam portion of the locking mechanism 66 projects through an opening 70 in the top surface 56 of the second engagement plate 28. The cam portion of the locking mechanism 66 is received within an aligned slot 72 on the bottom surface 38 of the first engagement plate 26. When the cam portion is expanded into the slot 72 on the bottom surface 38 of the first plate 26, the plates 26, 28 cannot be slidably moved across one another and therefore cannot be removed from one another. In order to remove the plates 26, 28 from one another the locking mechanism 66 must be disengaged thereby releasing the cam from the slot 72 on the first engagement plate 26.

Figure 6:
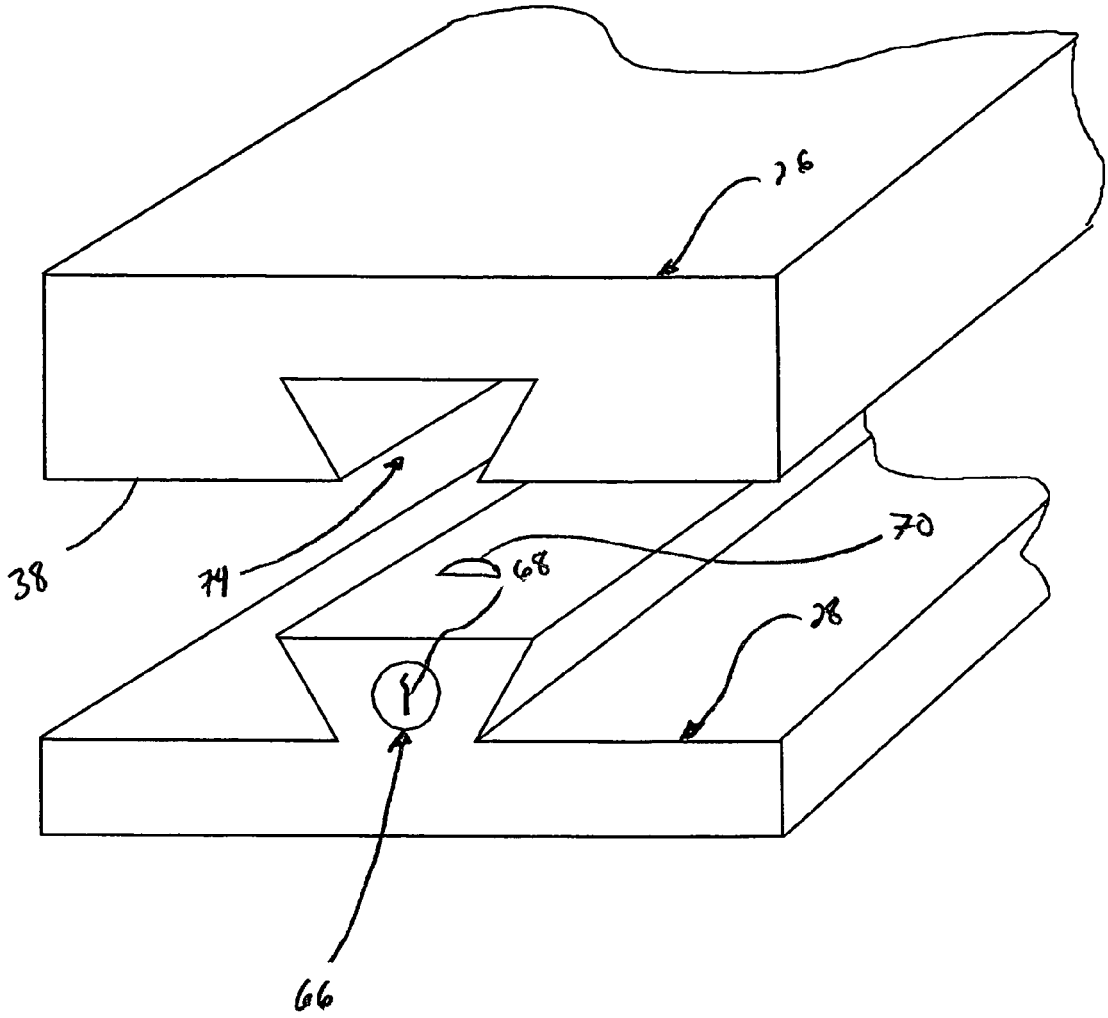
FIG. 6 is a partially cutaway perspective view of an alternative embodiment for the attachment plates of the present invention.

FIG. 6 illustrates an alternative preferred embodiment of the detachable mailbox of the present invention. The alternative embodiment shown in FIG. 6 shares several of the key components of the embodiment discussed in reference to FIGS. 1–5, and therefore those shared components need not be discussed in detail and will be referred to using like numerals. FIG. 6 illustrates an alternative means of attachment between the first 26 and second 28 attachment plates. As illustrated by FIG. 6, the center of the bottom surface 38 of the first attachment plate 26 defines a groove 74 running through the length of the plate. The second attachment plate 28 defines a flange 76 configured to fit within the groove 74 of the first attachment plates 26. The configuration of the flange 76 and groove 74 allows the attachment plates 24, 26 to be slidably attached to one another and replaces the tabs 44 and hole 42 arrangement illustrated in FIGS. 1–5.

Figure 7:
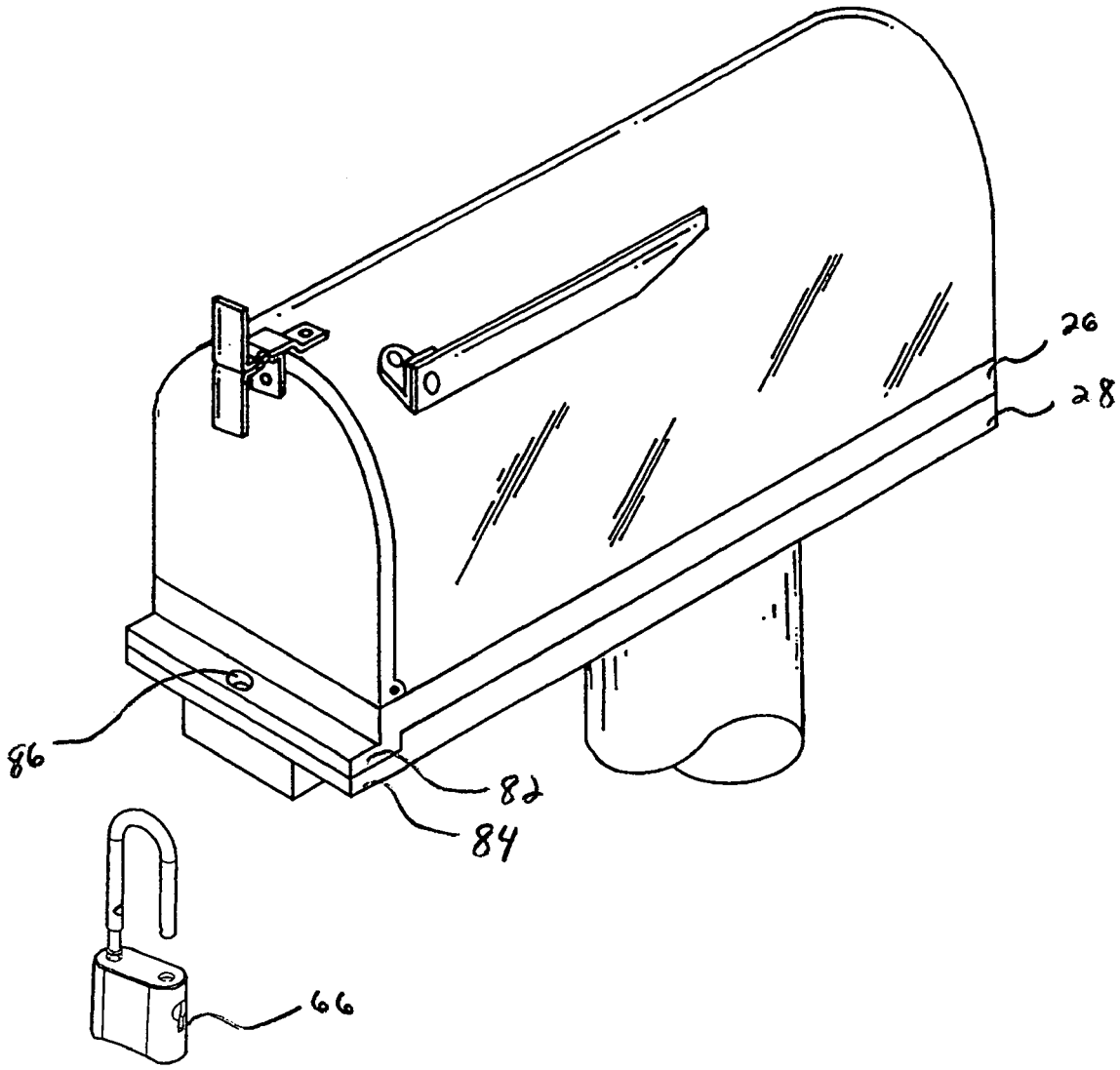
FIG. 7 is a perspective illustration of an alternative embodiment for the attachment plates of the present invention illustrating a locking lip.

FIG. 7 illustrates another alternative preferred embodiment of the detachable mailbox of the present invention. The alternative embodiment shown in FIG. 7 shares several of the key components of the embodiment discussed in reference to FIGS. 1–6, and therefore those shared components need not be discussed in detail and will be referred to using like numerals. FIG. 7 illustrates an alternative locking mechanism for securing the first 26 and second 28 attachment plates to one another to prevent theft of the mailbox.

As illustrated by FIG. 7, attachment plates 26, 28 further comprise a pair of locking lips 82, 84 extending from the front faces 32, 52 of the respective attachment plates 26, 28. The first attachment plate 26 includes a first attachment plate locking lip 82 extending forward from the lowest edge of the front side 32 of the of the first attachment plate 26 and extending the width of the first attachment plate 26. The first attachment plate locking lip 82 extends beyond the horizontal post 22. Likewise, the second attachment plate 28 includes a second attachment plate locking lip 84 extending forward from the lowest edge of the front side 52 of the of the second attachment plate 28 and extending the width of the second attachment plate 26. The second attachment plate locking lip 84 extends beyond the horizontal post 22 and is configured to align with the first lip 82. A lock receiving hole 86 extends through the lips 82, 84. The lock receiving hole 86 is configured to receive the locking arm or a conventional padlock or other lock known in the art. When a lock is inserted through the lock receiving hole, the sliding motion required to disengage the attachment plates 26, 28 cannot be performed and thus removal of the mailbox 12 is prevented.

3. In Use and Operation

The inventive attachment plates 26, 28 are configured to be used with any type of delivery receiving box and mailbox known in the art to convert the traditional assemblies into a quick release box assembly. This includes well mounted mailboxes also. The inventive assembly could be manufactured and sold in a variety of ways. For instance, the plates 26, 28 could be sold separately from mailboxes and mailbox posts in order to convert existing assemblies into quick release mailbox assemblies. Alternatively, mailboxes and mailbox posts could be sold with the attachment plates already attached to the post and mailbox. Additionally, the attachment plates could be manufactured in a variety of sizes to accommodate alternative styles and shapes of such boxes.

If an individual desires to attach the plates to an existing assembly, they must first attach the plates 26, 28 to the respective mounting elements. In one preferred embodiment, the first attachment plate 26 is attached to the base plate 16 of a mailbox 12. The mailbox engaging surface 36 of the attachment plate 26 should be aligned with the underside of the base plate 16 of the mailbox 12. Depending on the configuration of the base plate 16 of the mailbox 12, the placement of the first attachment plate 26 may vary slightly. If the attachment plate 26 exhibits the same size as the base plate 16, the edges of the attachment plate 26 should be aligned with the edges of the base plate 16. Alternatively, if the base plate 16 is larger than the attachment plate 26, or the attachment plate 26 is larger than the base plate, the attachment plate 26 should be centered on the base plate 16 of the mailbox 12. Once the attachment plate is centered, an attachment means such as a screw, rivet, nut and bolt assembly, or other known attachment means should be inserted through the apertures 40 on the attachment plate 26 and into the base plate 16 of the mailbox 12, thereby securing the first attachment plate 26 to the mailbox 12.

The second attachment plate 28 is then secured to the mailbox post 14. The groove 62 on the bottom surface 58 of the second attachment plate 28 should be placed over the horizontal support 22 of the mailbox post 12. The second attachment plate 28 should then be centered, or placed in the desired position on the horizontal support 22 and an attachment means such as a screw, nut and bolt assembly, rivet or other attachment means, should be inserted through the apertures 64 into the horizontal support 22, thereby securing the second attachment plate 28 to the mailbox post 14.

Having secured the attachment plates 26, 28 to the mailbox 12 and the mailbox post 14, the plates 26, 28 are then connected to one another thereby completing the assembly. Referring to the embodiment shown in FIGS. 1–5, the tab receiving holes 42 of the plate engaging surface 38 of the first attachment plate 26 should be should be aligned with the tabs 44 of the second attachment plate. The first attachment plate 26 should be placed over the second attachment plate in a manner such that the circular tab portion 48 of the engagement tab 44 fits within the circular portion 45 of the tab receiving holes 42. The first attachment plate is then slid backwards slightly such that the circular tab portion 48 is now substantially aligned with the narrow slot 46 and therefore the plates 26, 28 cannot be pulled apart.

Alternatively, if the attachment plates 26, 28 include the flange 76 and groove 74 arrangement illustrated in FIG. 6, the first plate 26 is aligned in front of the second plate 28, such that the groove 74 of the first attachment plate 26 is aligned with the flange 76, of the second attachment plate 28. The first attachment plate 26 is then slid across the second attachment plate 28 on the flange 76 until the plates 26, 28 are aligned on top of each other.

In order to secure the plates to one another, a key is inserted and the locking mechanism 66 is actuated such that the cam portion extends and fits within the slot 72 on the first engagement plate. Movement of the plates 26, 28 is now restricted and the mailbox 12 is locked to the mailbox post 14. Alternatively, referring to FIG. 7, once the plates 26, 28 and locking lips 72, 74 are aligned and secured in place, a padlock or other known lock is inserted through the hole 86 on the lips 72, 74 thereby restricting movement of the plates 26, 28 and locking them together.

In order to remove the mailbox 12 from the mailbox post 14, either the padlock or the locking mechanism 66 must be disengaged. Referring to the embodiment illustrated in FIGS. 1–5, the first engagement plate can then be slid forward such that the circular tab portion 48 of the engagement tab 44 is aligned with the circular portion 45 of the tab receiving holes 42. The first attachment plate 26 and thus the mailbox 12 can then be removed. Alternatively, referring to the embodiment shown in FIG. 6, once the lock or locking mechanism 66 has been disengaged, the plates 26, 28 can be slid apart.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

I claim:

1. A quick release box assembly comprising:

a housing having a top and a bottom defining an enclosure for receiving deliveries through an opening at one end;

a first attachment plate configured to be removably attached to the bottom of the housing;

a second attachment plate configured to be removably attached to a mailbox post and releasably engageable with the first attachment plate thereby connecting the housing to the mailbox post;

a locking mechanism configured to secure the first attachment plate to the second attachment plate;

wherein the locking mechanism comprises a locking means fitted within one of the attachment plates, and a lock receiving means on the other of the plates configured to receive the locking means;

wherein the locking means comprises a lock including a cylinder and a movable cam and the lock receiving means comprises a groove configured to receive the cam.

2. The box assembly of claim 1, wherein the first attachment plate comprises a groove on its underside and the second attachment plate comprises a flange on its top side configured to fit within the groove and secure the first attachment plate to the second attachment plate.

3. The box assembly of claim 1, wherein the first attachment plate comprises at least one hole on its underside and the second attachment plate comprises at least one tab configured to be received within the hole.

4. The box assembly of claim 1, further comprising a slot on the underside of the second attachment plate configured to fit on a support beam of the mailbox post.

5. The box assembly of claim 1, wherein the first attachment plate comprises at least one hole on a top side configured to receive an attachment means for attaching the first attachment plate to the bottom of the housing.

6. The box assembly of claim 1, wherein the second attachment plate comprises at least one hole on an underside configured to receive an attachment means for attaching the second attachment plate to the mailbox post.

7. The box assembly of claim of claim 1, wherein the housing includes decorative indicia including at least one of: a sports team and a holiday theme.

8. A method of attaching a mailbox with an attachment device comprising the steps of:

a. securing a first attachment plate to a bottom of the mailbox;

b. securing a second attachment plate to a mailbox post;

c. connecting the first attachment plate to the second attachment plate; and d. locking the first attachment plate to the second attachment plate with a locking means on one of the attachment plates having a cylinder and a movable cam and a lock receiving means on the other of the plates comprising a groove configured to receive the cam.

9. The method of claim 8, wherein the first attachment plate further comprises a groove on an underside and the second attachment plate further comprises a flange on a top side configured to fit within the groove and secure the first attachment plate to the second attachment plate.

10. The method of claim 8, wherein the first attachment plate further comprises at least one hole on an underside configured to receive at least one friction fitted tab and the second attachment plate comprises at least one of said tabs configured to be received within the hole.

11. The box assembly of claim 1, wherein at least one of the attachment plates is generally rectangular in shape.

12. The box assembly of claim 1, wherein the attachment plates are created from a relatively durable and weather-resistant material.

13. The box assembly of claim 1, wherein the first and second attachment plates are configured so as to be slidably attached to one another.

14. The method of claim 8, wherein the attachment plates are configured to be slidably attached to one another.

15. The method of claim 8, wherein the first attachment plate exhibits the same size as the bottom of the mailbox and the first attachment plate is aligned with edges of the bottom of the mailbox.

16. The method of claim 8, wherein the first attachment plate is larger than or smaller than the bottom of the mailbox and the first attachment plate is centered on the bottom of the mailbox.

17. A quick release box assembly comprising:

a mailbox;

a first attachment plate configured to be secured to a bottom of the mailbox;

a second attachment plate configured to be secured to a mailbox post;

a device for releasably securing the first attachment plate to the second attachment plate;

wherein the device comprises a locking means fitted within one of the attachment plates, and a lock receiving means on the other of the plates configured to receive the locking means;

wherein the locking means comprises a lock including a cylinder and a movable cam and the lock receiving means comprises a groove configured to receive the cam.

18. The box assembly of claim 17, wherein the mailbox includes decorative indicia including at least one of: a sports team and a holiday theme.

19. The box assembly of claim 17, further comprising a slot on an underside of the second attachment plate configured to fit on a support beam of the mailbox post.

20. The box assembly of claim 17, wherein the first attachment plate comprises at least one hole on a top side configured to receive an attachment means for attaching the first attachment plate to a bottom of the mailbox.

* * * * *